US005958190A

United States Patent [19]

Gregersen et al.

[11] Patent Number: 5,958,190

[45] Date of Patent: Sep. 28, 1999

[54] CLEANING APPARATUS FOR CLEANING A FORMING WIRE

[75] Inventors: Matthew L. Gregersen, Rockton, Ill.; Paul P. Newton; David E. Oldenburg, both of Beloit, Wis.; Jeffrey H. Pulkowski, Roscoe, Ill.; Jay Shands, Beloit, Wis.

[73] Assignee: Beloit Technologies, Inc., Wilmington, Del.

[21] Appl. No.: 08/882,092

[22] Filed: Jun. 25, 1997

[51] Int. Cl.[6] ..... D21F 1/32; B08B 1/02; B08B 3/02

[52] U.S. Cl. ..... 162/275; 162/274; 134/15; 134/122 R; 15/306.1; 15/307; 15/316.1; 68/62

[58] Field of Search ..... 162/275, 272, 162/274, 199; 134/122 R, 64 R, 15; 239/101, DIG. 7; 15/307, 316.1, 306.1; 8/151, 158; 68/62, 20, 205 R; 19/200

[56] References Cited

U.S. PATENT DOCUMENTS

| | | | |
|---|---|---|---|
| 1,395,219 | 10/1921 | Bennet | 162/275 |
| 2,352,991 | 7/1944 | Vickery | 92/50 |
| 3,859,163 | 1/1975 | Haythornthwaite | 162/198 |
| 4,270,978 | 6/1981 | Fioravanti | 162/199 |
| 4,474,644 | 10/1984 | Poulsen | 162/199 |
| 5,660,688 | 8/1997 | Kiviranta | 162/199 |

FOREIGN PATENT DOCUMENTS

29612081 U1 7/1997 Germany .

*Primary Examiner*—Stanley S. Silverman
*Assistant Examiner*—José S. Fortuna
*Attorney, Agent, or Firm*—Raymond W. Campbell; David J. Archer; Gerald A. Mathews

[57] ABSTRACT

A cleaning apparatus is disclosed for cleaning a forming wire of a paper machine. The apparatus includes a shower which is disposed adjacent to the forming wire for applying a shower of cleaning fluid to the wire. A blow box is disposed closely adjacent to the forming wire and downstream relative to the shower. The box is connected to a source of pressurized air for blowing a jet of air through the wire for removing the cleaning fluid therefrom. A plate is disposed between the box and the wire. The plate defines a plurality of slots which are disposed obliquely to a direction of movement of the wire in order to supply a multiplicity of pressure pulses to the wire for removing contaminants therefrom.

8 Claims, 1 Drawing Sheet

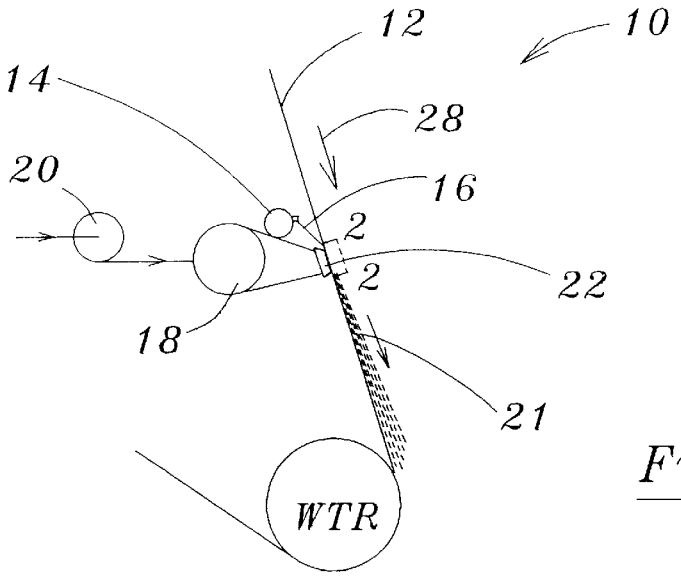
Fig. 1.
Fig. 2.
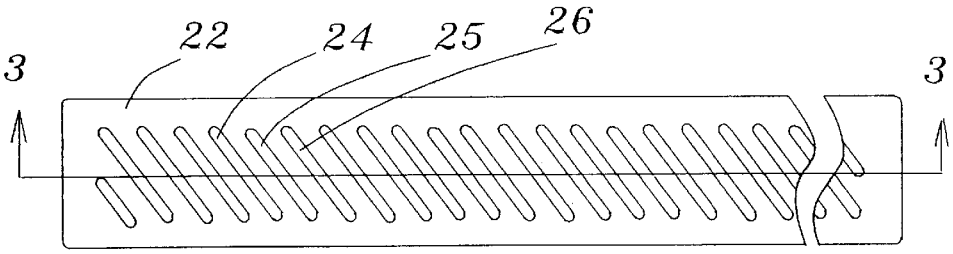
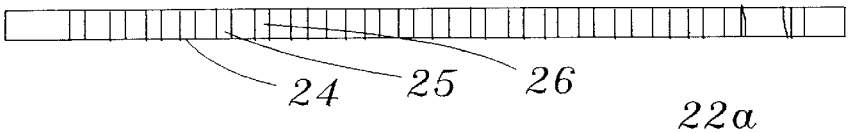
Fig. 3.
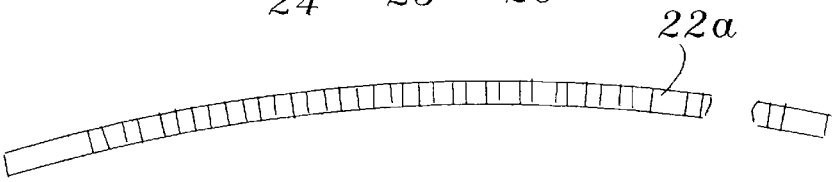
Fig. 4.

CLEANING APPARATUS FOR CLEANING A FORMING WIRE

BACKGROUND OF THE INVENTION

1. Field of the Invention

The present invention relates to a cleaning apparatus for cleaning a forming wire of a paper machine.

More specifically, the present invention relates to a cleaning apparatus for applying water to a forming wire for removing contaminants therefrom.

2. Description of Related Art

In the papermaking art, paper pulp is ejected onto a moving forming wire so that water within the pulp is drained therethrough thus leaving behind a formed web on the forming wire.

After a period of time, there is a tendency for contaminants within the pulp to become enlodged within the interses of the forming wire. Such contaminants and fines tend to reduce the quality of the resultant paper web.

Consequently, cleaning devices have been proposed for showering the forming wire with water for removing contaminants therefrom.

The present invention provides an improved cleaning apparatus which includes a shower for showering the forming wire with cleaning fluid such as water and then subsequently blowing a jet of air through the forming wire for removing the cleaning fluid therefrom.

The present invention includes a plate disposed between a blow box and the forming wire. Such plate defines a plurality of slots which supply a multiplicity of pressure pulses to the wire for removing the contaminants therefrom.

Other objects and advantages of the present invention will be readily apparent to those skilled in the art by consideration of the detailed description contained hereinafter taken in conjunction with the annexed drawings.

SUMMARY OF THE INVENTION

The present invention relates to a cleaning apparatus for cleaning a forming wire of a paper machine. The apparatus includes a shower which is disposed adjacent to the forming wire for applying a shower of cleaning fluid to the wire.

A blow box is disposed closely adjacent to the forming wire and downstream relative to the shower. The box is connected to a source of pressurized air for blowing a jet of air through the wire for removing the cleaning fluid therefrom.

A plate is disposed between the box and the wire. The plate defines a plurality of slots which are disposed obliquely to a direction of movement of the wire in order to supply a multiplicity of pressure pulses to the wire for removing any contaminants therefrom.

In a more specific embodiment of the present invention, the shower is disposed on the same side of the wire as the blow box.

Additionally, the cleaning fluid is water.

Also, the jet of air is blown angularly relative to the wire for removing the fluid and any contaminants contained therein from the wire.

The plate is disposed across the entire cross-machine directional width of the forming wire.

The slots are disposed parallel relative to each other, the plate being of flat configuration.

In an alternative embodiment of the present invention, the plate is of curved configuration.

Many modifications and variations of the present invention will be readily apparent to those skilled in the art by consideration of the detailed description contained hereinafter.

However, such modifications and variations fall within the spirit and scope of the present invention as defined by the appended claims.

BRIEF DESCRIPTION OF THE DRAWINGS

FIG. 1 is a side elevational view of a cleaning apparatus according to the present invention.

FIG. 2 is an enlarged view taken on the line 2—2 of FIG. 1 and shows the plate;

FIG. 3 is a sectional view taken on the line 3—3 of FIG. 2; and

FIG. 4 is a similar view to that shown in FIG. 3 but shows an alternative embodiment of the present invention in which the plate is of curved configuration.

DETAILED DESCRIPTION OF THE DRAWINGS

FIG. 1 is a side-elevational view of a cleaning apparatus generally designated 10 according to the present invention.

The cleaning apparatus 10 includes a forming wire 12 of a paper machine. The apparatus 10 includes a shower 14 which is disposed adjacent to the wire 12 for applying a shower of cleaning fluid 16 to the wire 12.

As shown in FIG. 1, a blow box 18 is disposed closely adjacent to the wire 12 and downstream relative to the shower 14. The box 18 is connected to a source of pressurized air 20 for blowing a jet of air as indicated by the arrow 21 through the wire 12 for removing the cleaning fluid 16 therefrom.

A plate 22 is disposed between the box 18 and the wire 12. The plate 22 defines a plurality of slots 24, 25, 26 as shown in FIG. 2 disposed obliquely to a direction of movement of the wire 12 as indicated by the arrow 28 in order to supply multiplicity of pressure pulses to the wire 12 for removing contaminants therefrom.

In a preferred embodiment of the present invention, the shower 14 is disposed on the same side of the wire 12 as the blow box 18.

Also, the cleaning fluid 16 is water.

The jet of air 21 is directed angularly relative to the wire 12 for removing the fluid 16 and the contaminants contained therein from the forming wire 12.

The plate 22 extends across the entire cross-machine directional width of the forming wire 12 with the slots being disposed parallel relative to each other.

In the preferred embodiment of the present invention as shown in FIG. 3, the plate 22 is of flat configuration.

In an alternative embodiment of the present invention as shown in FIG. 4, the plate 22A is of curved configuration.

The present invention provides a unique cleaning apparatus which has an improved structural integrity and which enables a multiplicity of pressure pulses to be applied to the forming wire for improved removal therefrom of contaminants.

What is claimed is:

1. A cleaning apparatus for cleaning a forming wire of a paper machine, said apparatus comprising:

a shower disposed adjacent to the wire for applying a shower of cleaning liquid to the forming wire;

a blow box disposed closely adjacent to the forming wire and downstream relative to said shower, said box being connected to a source of pressurized air for blowing a jet of air through the wire for removing the cleaning therefrom; and a plate disposed between said box and the forming wire, said plate defining a plurality of slots disposed obliquely to a direction of movement of the forming wire in order to supply a multiplicity of pressure pulses to the wire for removing contaminants therefrom.

2. A cleaning apparatus as set forth in claim 1 wherein said shower is disposed on a same side of the forming wire as said blow box.

3. A cleaning apparatus as set forth in claim 1 wherein said cleaning fluid is water.

4. A cleaning apparatus as set forth in claim 1 wherein said jet of air is directed angularly relative to the forming wire for removing the cleaning fluid and any contaminants contained therein from the forming wire.

5. A cleaning apparatus as set forth in claim 1 wherein said plate extends in a cross-machine direction over the entire width of the forming wire.

6. A cleaning apparatus as set forth in claim 1 wherein said plurality of slots are disposed parallel relative to each other for increasing the structural integrity of said plate.

7. A cleaning apparatus as set forth in claim 1 wherein said plate is flat.

8. A cleaning apparatus as set forth in claim 1 wherein said plate is of curved configuration.

* * * * *